US008491424B2

(12) United States Patent
Wang

(10) Patent No.: US 8,491,424 B2
(45) Date of Patent: Jul. 23, 2013

(54) FOLDING ASSEMBLY OF TABLE TENNIS TABLE

(76) Inventor: Leao Wang, Taichung (TW)

( * ) Notice: Subject to any disclaimer, the term of this patent is extended or adjusted under 35 U.S.C. 154(b) by 35 days.

(21) Appl. No.: 13/337,269

(22) Filed: Dec. 26, 2011

(65) Prior Publication Data

US 2013/0165277 A1 Jun. 27, 2013

(51) Int. Cl.
*A63B 67/04* (2006.01)

(52) U.S. Cl.
USPC ..... 473/496

(58) Field of Classification Search
USPC ..... 473/496; 108/115, 118, 162, 166–176; 248/188, 188.1, 188.6
See application file for complete search history.

(56) References Cited

U.S. PATENT DOCUMENTS

| | | | | |
|---|---|---|---|---|
| 3,777,674 | A * | 12/1973 | Parsons | 108/175 |
| 3,830,495 | A * | 8/1974 | Hill | 473/496 |
| 4,089,522 | A * | 5/1978 | Rock | 108/173 |
| 6,065,802 | A * | 5/2000 | Bue | 297/158.4 |
| 6,120,397 | A * | 9/2000 | Julian | 473/496 |
| 6,321,664 | B1 * | 11/2001 | Damour et al. | 108/168 |
| 7,490,562 | B2 * | 2/2009 | Cornilleau | 108/168 |
| 8,007,378 | B2 * | 8/2011 | Vallon et al. | 473/496 |

FOREIGN PATENT DOCUMENTS

CN 202407735 U * 9/2012

* cited by examiner

*Primary Examiner* — Raleigh W Chiu

(57) ABSTRACT

The present invention relates to a folding assembly of a table tennis table formed by a tabletop and inner and outer support stands, and mainly using a buckle mechanism to fold the tabletop and the inner and outer support stands in an upright position to facilitate the packaging, transportation, storage and moving of the table tennis table. The buckle mechanism includes a lever, two positioning covers, two buckle plates and two torsion springs, and the lever is provided for snapping a protruding pellet into a buckle notch of the buckle plate to achieve the effect of fixing and releasing the buckle between the tabletop and the outer support stand.

1 Claim, 7 Drawing Sheets

FOLDING ASSEMBLY OF TABLE TENNIS TABLE

BACKGROUND OF THE INVENTION

1. Fields of the Invention

The present invention relates to a folding assembly of a table tennis table, and more particularly to the folding assembly of a table tennis table that uses a buckle mechanism to quickly fold a tabletop and inner and outer support stands in an upright position to facilitate the packaging, transportation, storage and moving of the table tennis table.

2. Description of the Related Art

As we know, table tennis is a sport requiring an appropriate activity space, and the table itself occupies a certain volume, and users have to reserve a relatively large space for putting and using the table, and thus the design of a foldable table can reduce the space for storage and become an import basic design condition of the table tennis table.

At present, almost all table tennis tables come with the aforementioned design for folding the support stands to achieve the effect of reducing volume, and some conventional table tennis tables provide a direct, simple and easy way of disassembly the table easily, but the design of the folding mechanism of these conventional products always bring disappointments to users, since these tables are not secured and may be loosened easily. In some cases, these tables are not durable and even worse cannot be used anymore. Obviously, the conventional table tennis tables require further improvements.

SUMMARY OF THE INVENTION

Therefore, it is a primary object of the present invention to provide a folding assembly of a table tennis table with a design of a solid and durable buckle mechanism to quickly fold a tabletop and inner and outer support stands in an upright position to facilitate the packaging, transportation, storage and moving of the table tennis table.

According to the invention, a folding assembly of a table tennis table is formed by a tabletop and inner and outer support stands, A buckle mechanism is used to fold the tabletop and the inner and outer support stands in an upright position to facilitate the packaging, transportation, storage and moving of the table tennis table. The buckle mechanism includes a lever, two positioning covers, two buckle plates and two torsion springs, and the lever is provided for snapping a protruding pellet into a buckle notch of the buckle plate to achieve the effect of fixing and releasing the buckle between the tabletop and the outer support stand.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
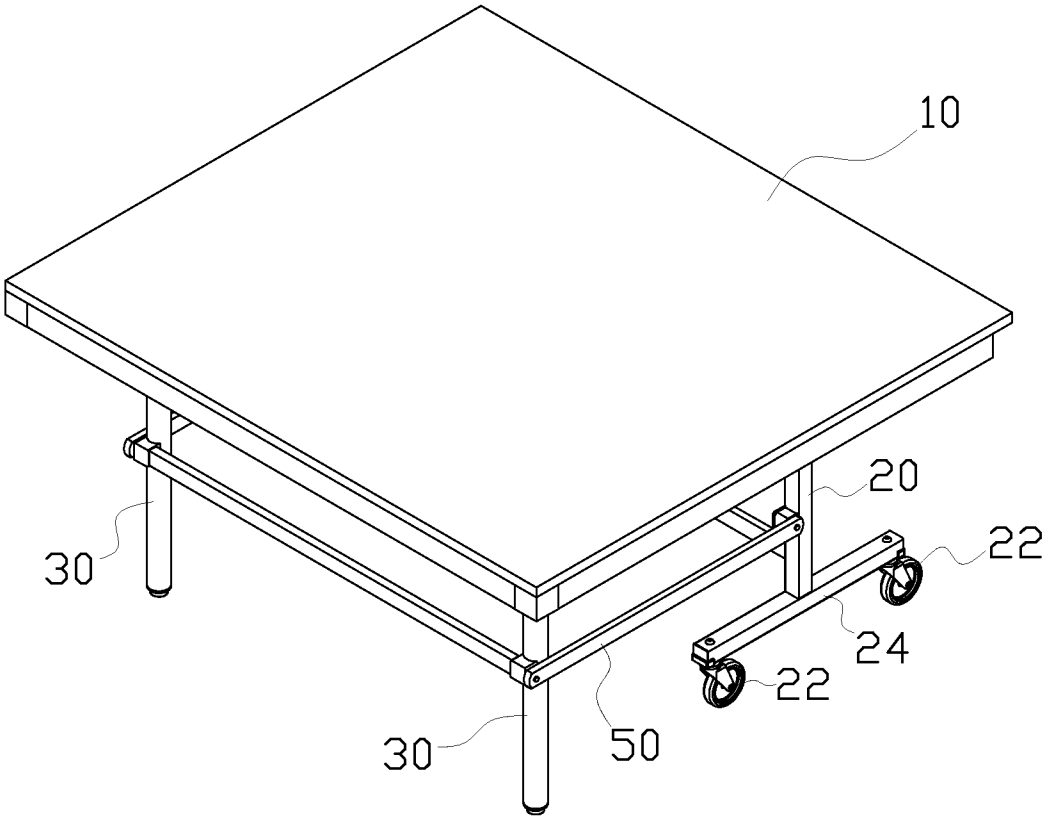
FIG. 1 is a perspective view of the present invention.
Figure 2:
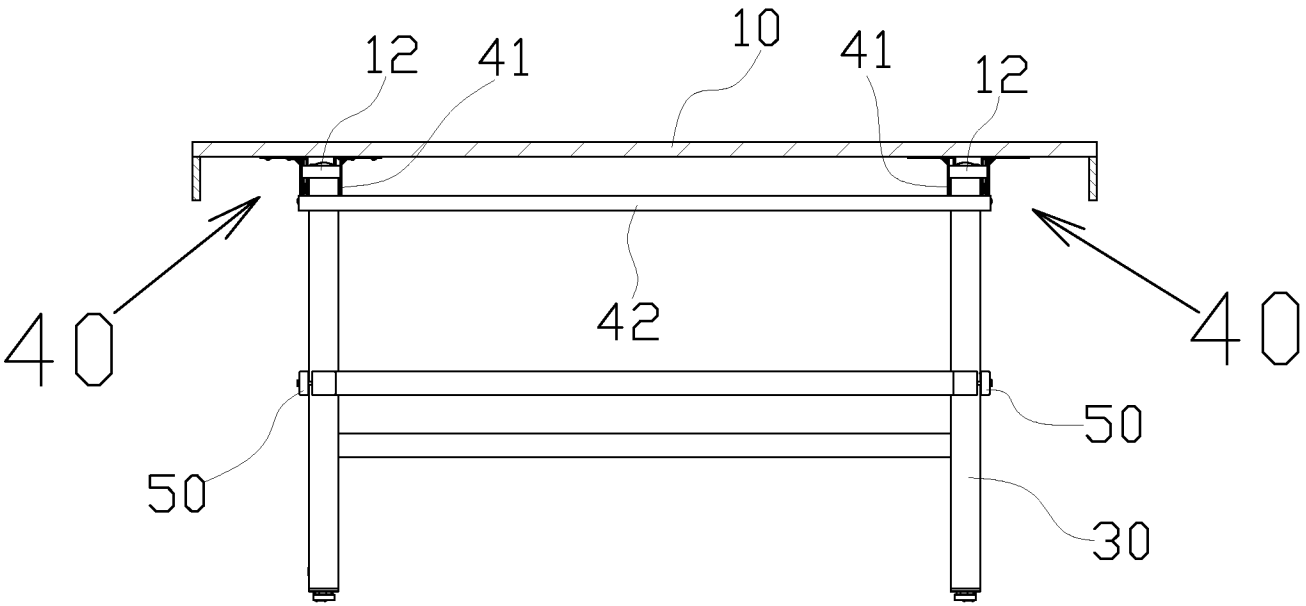
FIG. 2 is a partial cross-sectional planar view of the present invention.
Figure 3:
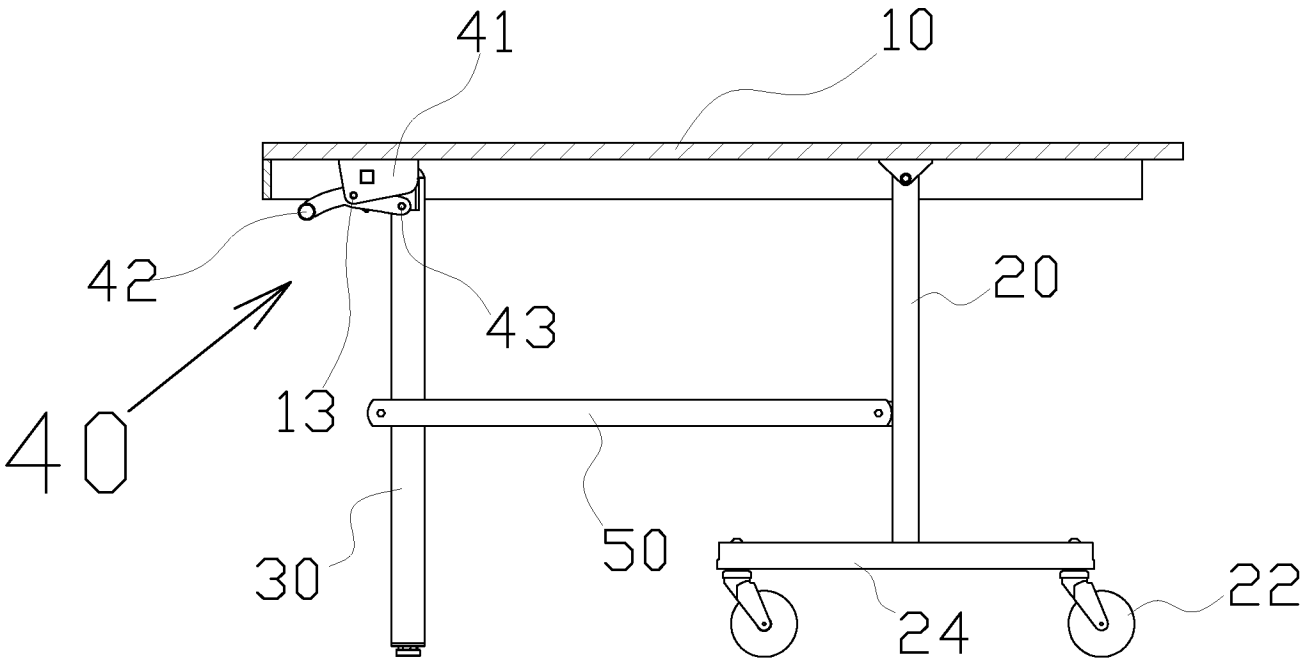
FIG. 3 is a partial cross-sectional side view of the present invention.
Figure 4:
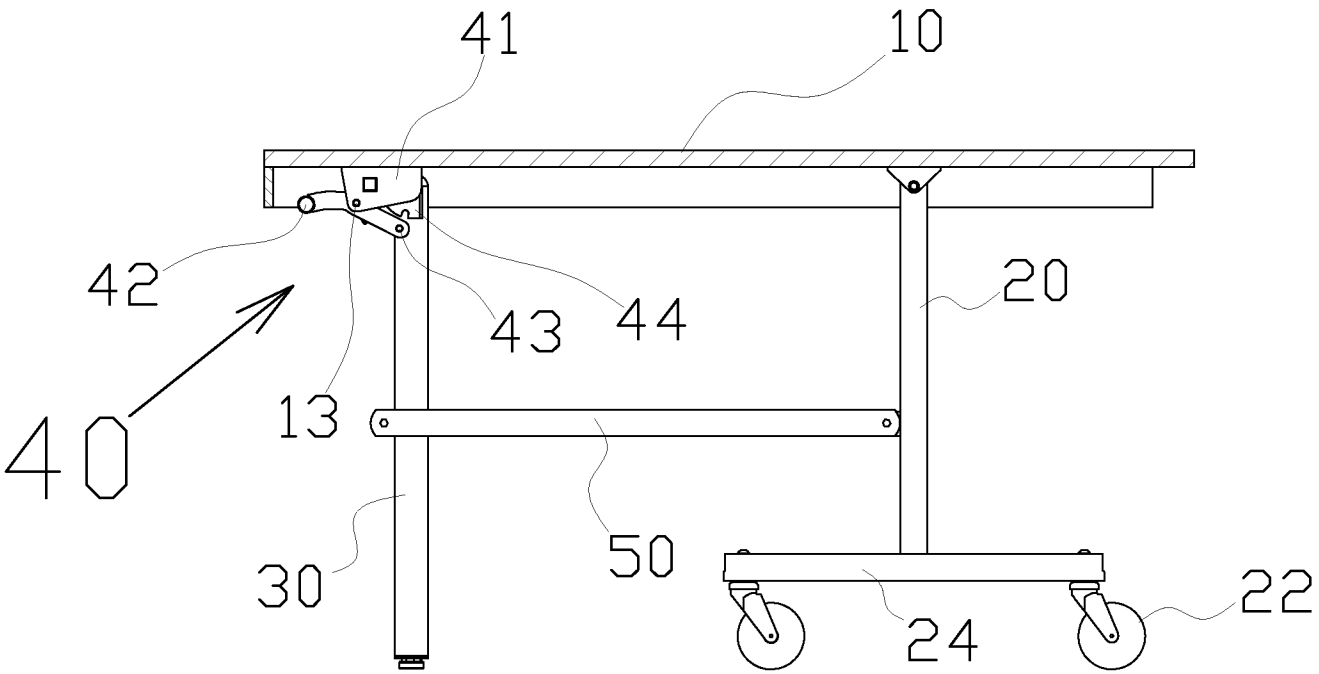
FIG. 4 is a schematic view of an operation as depicted in FIG. 3.
Figure 6:
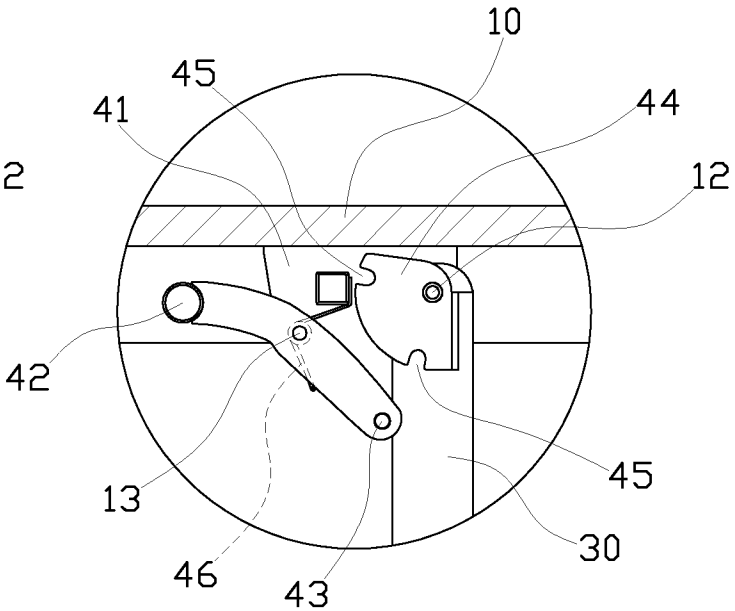
FIG. 6 is a schematic view of an operation as depicted in FIG. 5.
Figure 5:
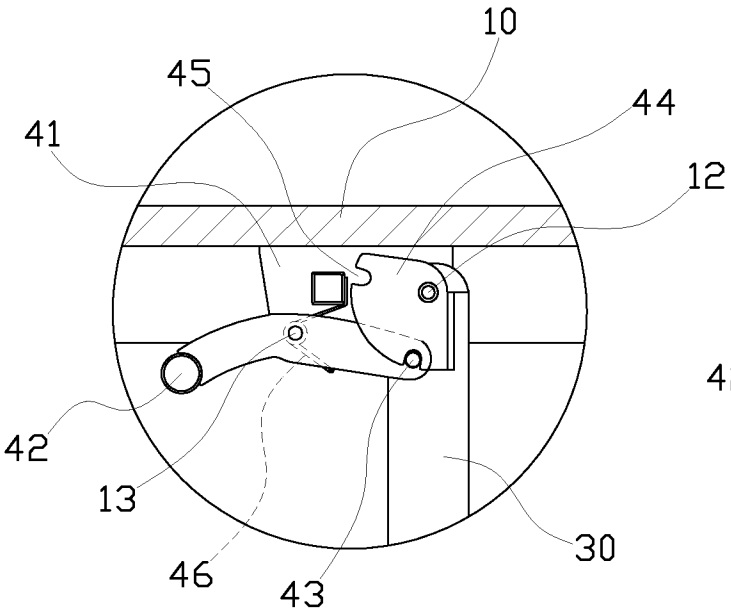
FIG. 5 is a partial cross-sectional close-up view of a buckle mechanism of the present invention.
Figure 7:
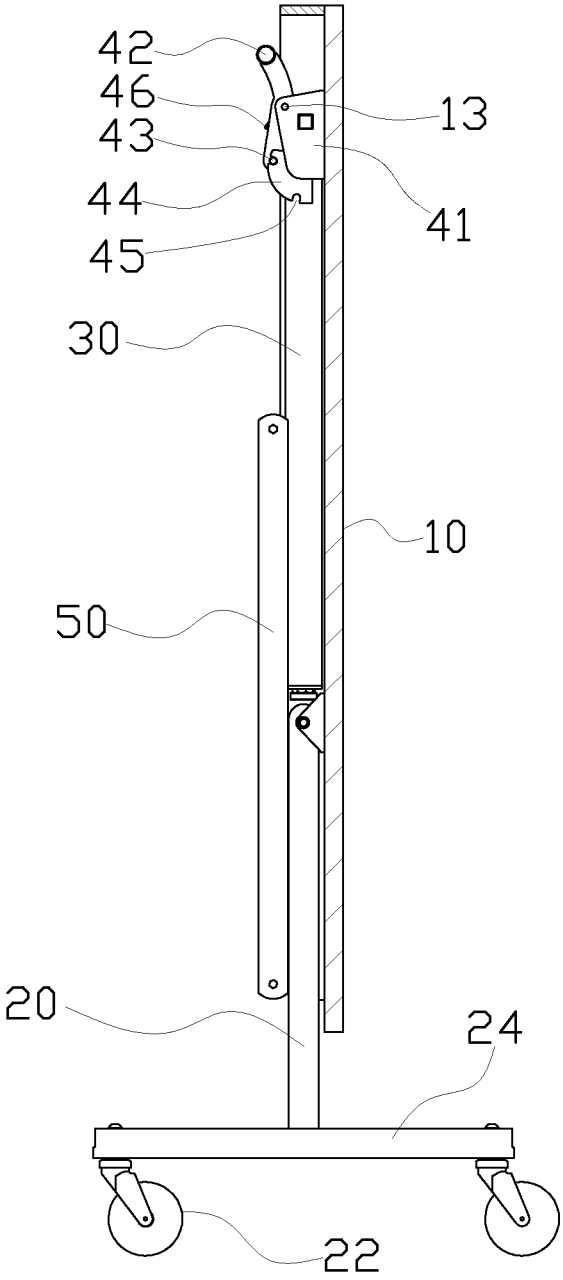
FIG. 7 is a partial cross-sectional view of a folded state of the present invention.

The technical measures and characteristics of the present invention will become apparent with the detailed description of preferred embodiments accompanied with related drawings as follows:

With reference to FIGS. 1 to 4 and 7 for a table tennis table of the present invention, the table tennis table comprises a tabletop 10, an inner support stand 20 and an outer support stand 30, and a buckle mechanism 40 is provided for quickly folding the tabletop 10 and the inner and outer support stands 20, 30 in an upright position (as shown in FIG. 7) to facilitate the packaging, transportation, storage and moving of the table tennis table.

The inner and outer support stands 20, 30 are respectively and pivotally coupled to appropriate positions of the bottom of the tabletop 10, wherein the outer support stand 30 is substantially H-shaped, and the inner support stand 20 is also substantially H-shaped, and a roller holder 24 having a ground-affixing roller set 22 separately coupled to the bottoms of both inner and outer support stands 20, 30, and a link rod 50 is pivotally coupled between the inner and outer support stands 20, 30.

With reference to FIGS. 2 to 6, the buckle mechanism 40 is installed at the pivoting position of the tabletop 10 and the outer support stand 30, and the buckle mechanism 40 comprises:

two positioning covers 41, fixed to both ends of the bottom of the tabletop 10 respectively, and pivotally coupled to the outer support stand 30 by a first pivot 12;

a lever 42, with both ends pivotally to the positioning cover 41 by a second pivot 13 and for snapping a protruding pellet 43 at a position of a buckle notch 45 of a buckle plate 44;

two buckle plates 44, disposed between the positioning cover 41 and the outer support stand 30, and fixed to the outer support stand 30, and having two buckle notches 45 formed at appropriate positions of the edge of the two bucket plates 44 respectively;

two torsion springs 46, installed between the positioning cover 41 and the lever 42 for pressing the lever 42 to snap the protruding pellet 43 in a direction towards the buckle notch 45 of the buckle plate 44;

thereby, with the aforementioned components as shown in FIG. 7, the lever 42 can be turn to release the protruding pellet 43 from the buckle notch 45, and turn the tabletop 10 upwardly in an upright position, and now the protruding pellet 43 is snapped into another buckle notch 45 automatically by the action of the torsion spring 46 to form a stop action, so that the tabletop 10 will not be turned over by accident to assure safety. Similarly, the same operating procedure can be used to turn the tabletop 10 back to its horizontal position easily.

Figure 8:
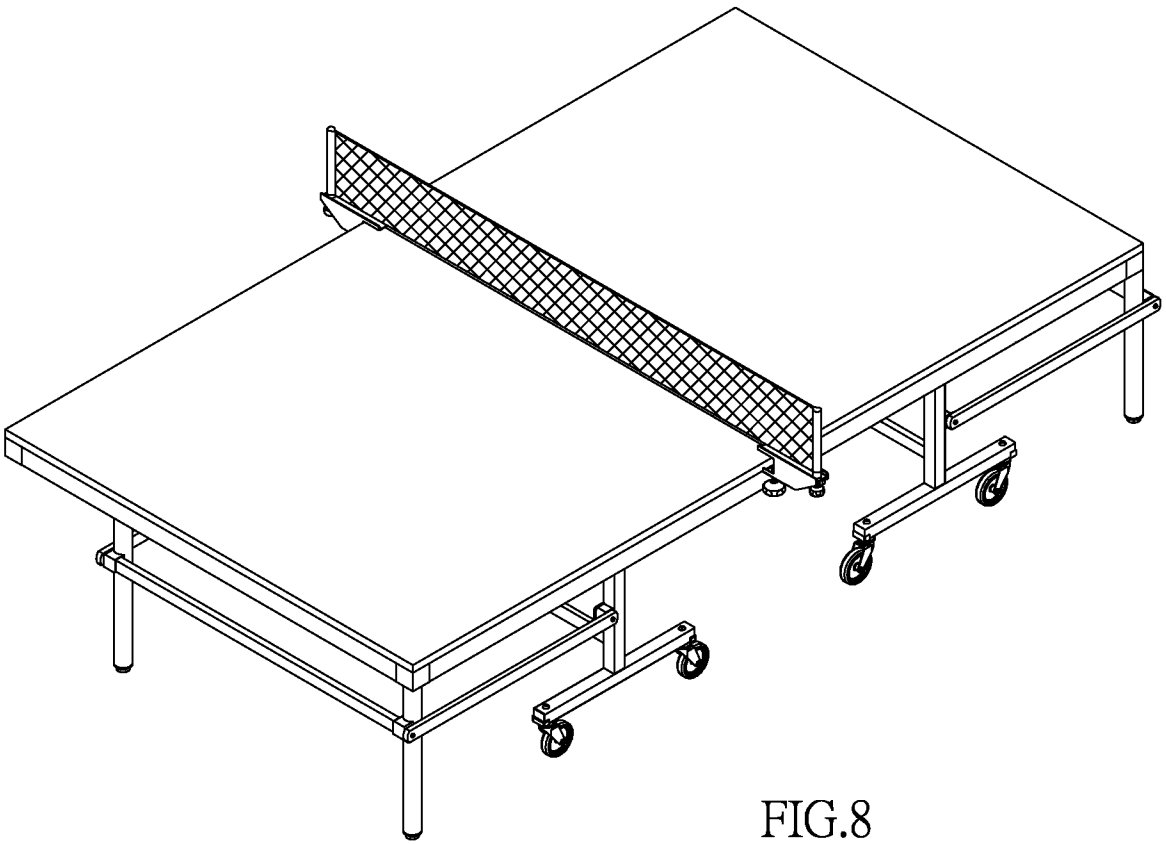
FIG. 8 is a schematic view of an actual application of the present invention.

In FIG. 8, a table tennis table is generally comprised of two independent tabletops and a net is installed at the middle between the two independent tabletops, but such arrangement is a prior art, and will not be described in details.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A folding assembly of a table tennis table, comprising a tabletop, an inner support stand and an outer support stand, and a buckle mechanism being provided for quickly folding the tabletop and the inner and outer support stands in an upright position, and the inner and outer support stands being pivotally coupled to the bottom of the tabletop, and a link rod being pivotally coupled between the inner and outer support stands, characterized in that the buckle mechanism is installed at a pivoting position of the tabletop and the outer support stand and comprises:

two positioning covers, fixed at both ends of the bottom of the tabletop respectively, and pivotally coupled to the outer support stand by a first pivot;

a lever, with both ends respectively and pivotally coupled to the positioning covers by a second pivot, and having a protruding pellet for snapping into a position of a buckle notch of a buckle plate;

two buckle plates, disposed between the positioning cover and the outer support stand, and fixed to the outer support stand, and having two buckle notches formed at appropriate positions of the edge of each buckle plate;

two torsion springs, each being installed between the positioning cover and the lever, for pressing the lever to turn in a direction from the protruding pellet towards the of the buckle plate buckle notch;

such that the lever can be provided for snapping the protruding pellet into a position of the buckle notch of the buckle plate to achieve the effect of positioning or releasing the buckle between the tabletop and the outer support stand.

* * * * *